US005362271A

United States Patent [19]

Butt

[11] Patent Number: 5,362,271

[45] Date of Patent: Nov. 8, 1994

[54] MAGNETIC PLAYTHINGS

[76] Inventor: Sandra L. Butt, 4374 Patterdale Dr., North Vancouver, British Columbia, Canada, V7R 4L7

[21] Appl. No.: 782,088

[22] Filed: Oct. 24, 1991

[51] Int. Cl.[5] ..... A63H 33/26

[52] U.S. Cl. ..... 446/139; 446/129

[58] Field of Search ..... 446/129, 139, 92, 137, 446/327, 390, 369

[56] References Cited

U.S. PATENT DOCUMENTS

| | | | |
|---|---|---|---|
| 2,775,064 | 12/1956 | Otto | 446/139 |
| 2,809,835 | 10/1957 | Berryhill, Jr. | 446/129 X |
| 3,409,295 | 11/1968 | Bernstein | 446/129 X |
| 3,613,301 | 10/1971 | Noble et al. | 446/327 |
| 4,404,766 | 9/1983 | Toth | 446/129 |
| 4,729,751 | 3/1988 | Schiavo et al. | 446/901 X |
| 5,071,385 | 12/1991 | Cox | 446/129 |

FOREIGN PATENT DOCUMENTS

| | | | |
|---|---|---|---|
| 257755 | 10/1948 | Switzerland | 446/139 |

*Primary Examiner*—Mickey Yu

*Attorney, Agent, or Firm*—Elbie R. de Kock; John R. Uren

[57] ABSTRACT

Playthings, such as dolls (10, 12), figures or toy animals (22) are provided. The playthings are provided singly or in pairs. The playthings have limbs, such as arms, or other appendages such as tails or trunks, extending from their bodies, the limbs or appendages being provided with connection elements, such as magnets (14), for removably attaching limbs together to simulate "hand holding" or to attach to metal surfaces or to "pick up" metal objects. In alternative embodiments the magnets are arranged so that they will repel each other so that certain limbs or appendages will not attach to each other. In another embodiment the playthings can be manipulated by the thumb and fingers, such as in the form of recesses (44) provided in the clothes or by strings (38), such as in the form of a marionette (46).

23 Claims, 5 Drawing Sheets

MAGNETIC PLAYTHINGS

FIELD OF THE INVENTION

This invention relates to magnetic playthings, such as dolls, figures or toy animals, which may be provided singly or in pairs.

BACKGROUND OF THE INVENTION

Magnets have been used in toys for their ability to attract or attach to metal objects. Magnets have also been utilized in the hands of dolls to attract objects, such as described in U.S. Pat. Nos. 3,696,553 and 3,731,427. However, these dolls are not able to hold each other's hands or their own hands, to provide new aspects of play or instruction with such dolls. It is accordingly an object of the present invention to provide playthings, which can be in the form of dolls, figures, plush animals, or any other suitable form, having hands or feet or other limbs or appendages provided with magnets or other attachment means to accomplish such actions as hand-holding, as well as holding onto other objects or surfaces.

SUMMARY OF THE INVENTION

According to one aspect of the invention, there is provided a plaything comprising a body, a pair of arms, each terminating in a hand, extending from said body and connection means on said hands for removably attaching the hands together.

According to another aspect of the invention, there is provided a pair of playthings, each comprising a body and at least one arm terminating in a hand on the body of each plaything and connection means on said hands for removably attaching the hands of the respective playthings together. In a preferred embodiment the attachment means comprises a magnet on the one hand and a magnetic material on the other hand. The magnetic material may be a permanent magnet or it may be a metal, such as iron. In an alternative embodiment of the invention, the magnets in the hands may be arranged in such a fashion that the magnets repel each other when the hands are brought together.

According to a further aspect of the invention the playthings can be hand-manipulated directly by the fingers of a hand, such as in the form of a glove puppet or they may be manipulated through intermediate means, such as strings, the plaything being in the form of a marionette.

According to another aspect of the invention there is provided a pair of playthings, each comprising a body and at least one limb extending from the body of each plaything and a magnet on each limb for magnetic interaction with each other. In the present specification the term "limb" also includes other appendages of an animal, such as a trunk or a tail.

Further objects and advantages of the invention will become apparent from the description of a preferred embodiment of the invention below.

DETAILED DESCRIPTION

Figure 1:
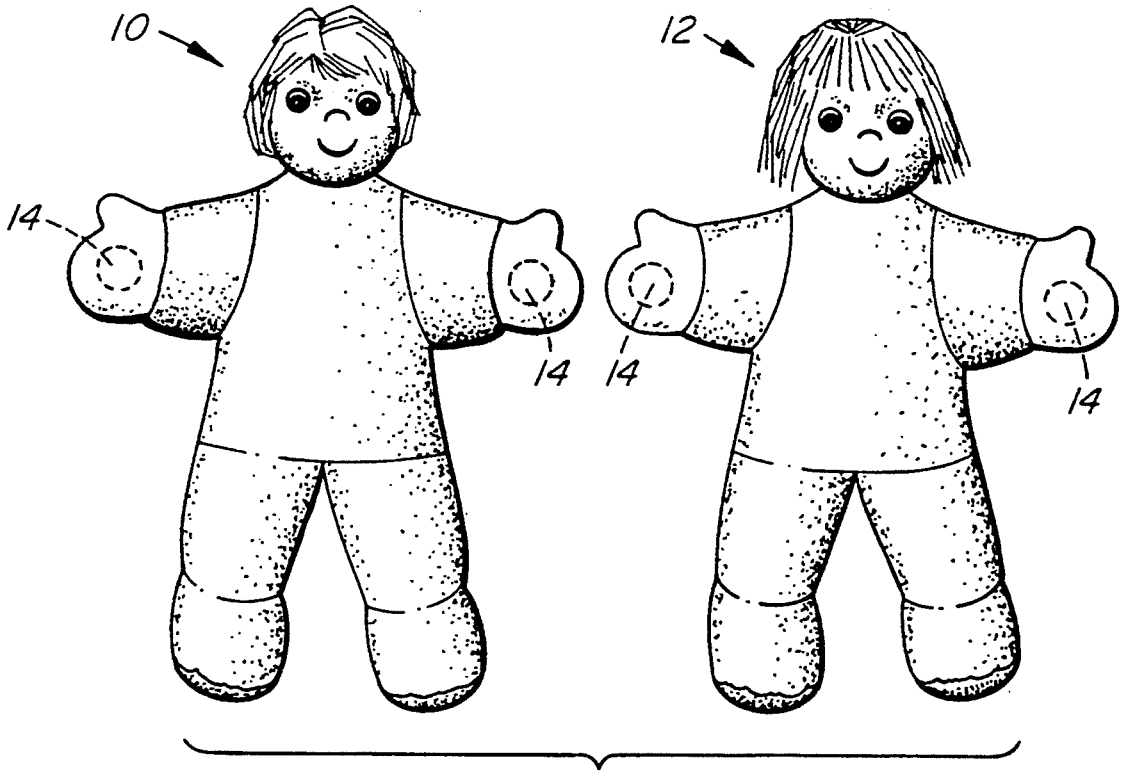
FIG. 1 is a schematical illustration of a pair of dolls according to the invention.
Figure 7:
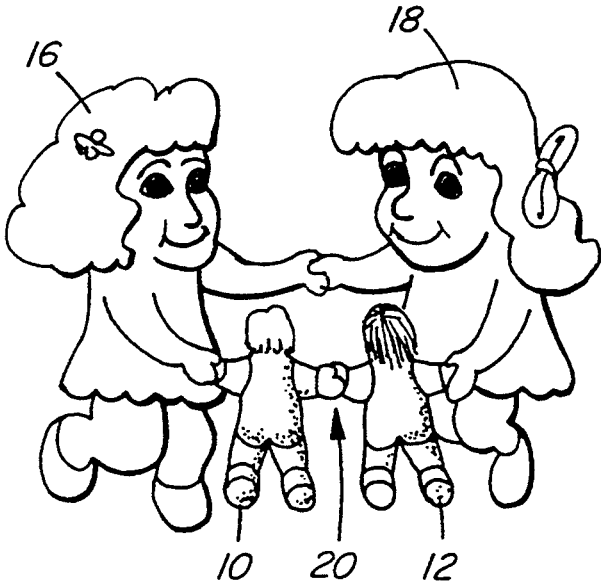
FIG. 7 is a schematical illustration showing a pair of dolls according to the invention in a hand-holding relationship.

In FIG. 1, reference numerals 10 and 12 generally indicate a pair of dolls according to one embodiment of the invention. The dolls 10, 12 are of any suitable material, such as a fabric skin with stuffing inside. Each has a pair of arms terminating in a pair of hands and with a magnet 14 provided on or in each hand. Since the dolls 10, 12 are stuffed dolls, their arms are flexible. The magnets are attached to the hands in any convenient manner, such as secured by means of a rivet and visible on the outside of the hand or concealed in the fabric, or encased in a moulded plastic material. By means of the magnets 14, each doll 10, 12 can "hold" its own hands or the hand of the other doll, as shown in FIG. 7 which schematically shows two children 16, 18, each holding the hand of a doll 10, 12, respectively, and the dolls 10, 12 "holding" each other's hands by virtue of the magnets, as shown at 20. In the specific embodiment shown in FIG. 1, the magnets 14 are shown as being provided in the "palms" of the hands.

Figure 9:
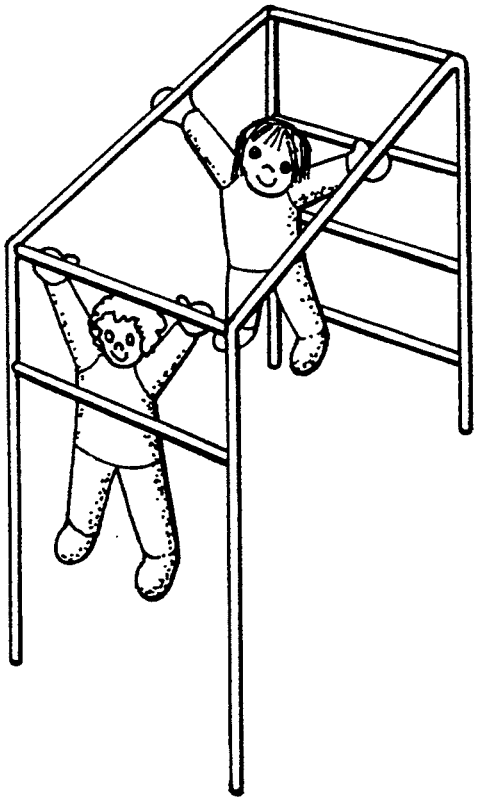
FIG. 9 is a schematical illustration showing dolls according to the invention attached to a metal object.

Thus, whereas each doll 10, 12 is a complete doll in itself, the dolls 10, 12 can be provided in pairs for conveying the idea of friendship or "pals", whereby the dolls can be seen to be holding each other's hands or the one doll "picking up" the other doll. The arms of the dolls can also be placed around each other's bodies and the hands attached so that the dolls will be simulating an embrace, a hug or piggy-backing. Each individual doll can be attached to a metal object or surface, such as a fridge, ladder, or climbing frame, such as shown in FIG. 9. The dolls can also be used to "pick up" metal objects or "playing" objects such as books, miniature dolls, or bottles provided with magnets therein.

Figure 8:
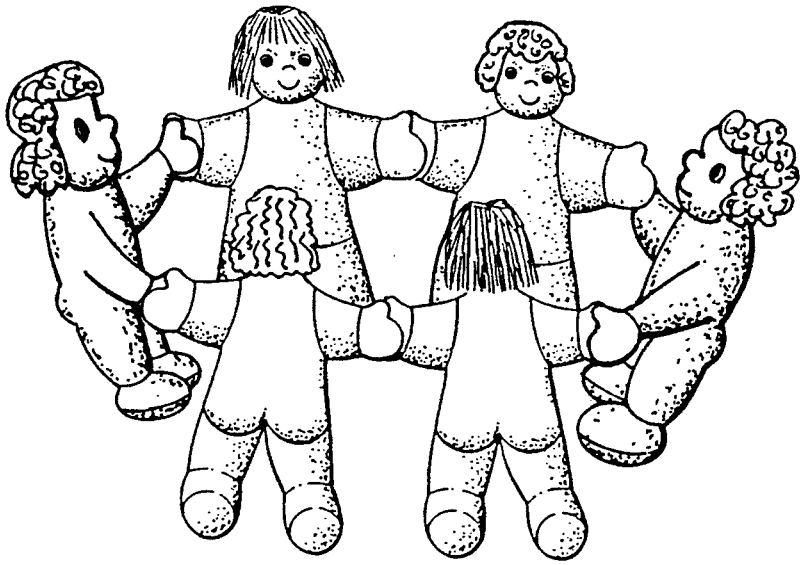
FIG. 8 is a schematical illustration showing a plurality of dolls according to the invention arranged in a circular hand-holding configuration.

In other applications, a plurality of dolls may be used, such as shown in FIG. 8, where a number of dolls are shown forming a circle in hand-holding relationship.

Figure 2:
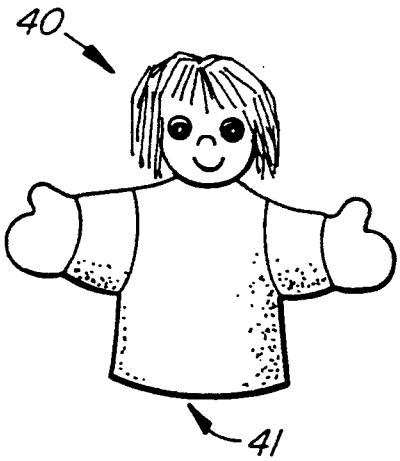
FIGS. 2 through 6 are schematical illustrations showing various embodiments of manipulative dolls according to the invention.

The dolls 10, 12 can be in the form of normal dolls as shown in FIG. 1 or they can be manipulative, such as being in the form of a glove puppet 40 as shown in FIG. 2. Thus, the hand can be inserted in the doll, as shown at 41, to manipulate the arms and head by means of the thumb and fingers of the hand. In this way, the doll can be manipulated to "hold" its own hands or to "pick up" magnetic objects or to "hold" the hand of another doll or to "pick up" another doll by the hand.

Figure 3:
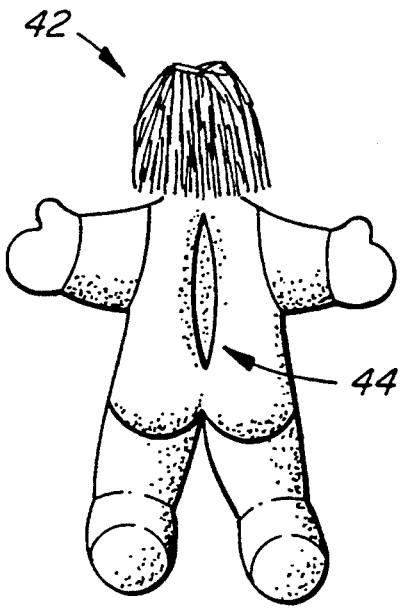

In a further embodiment shown in FIG. 3, the doll 42 has an opening 44 at the back of the doll for insertion of the hand therein to manipulate the arms and head of the doll. In this case, instead of being in the form of a glove puppet, the doll 42 is provided with legs as shown.

Figure 4:
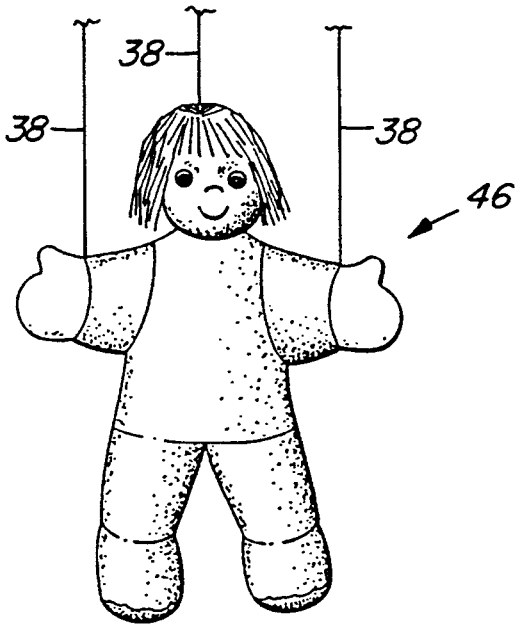

In the embodiment of FIG. 4, there is shown a doll 46 which is in the form of a marionette which can be manipulated by means of strings 38.

Figure 5:
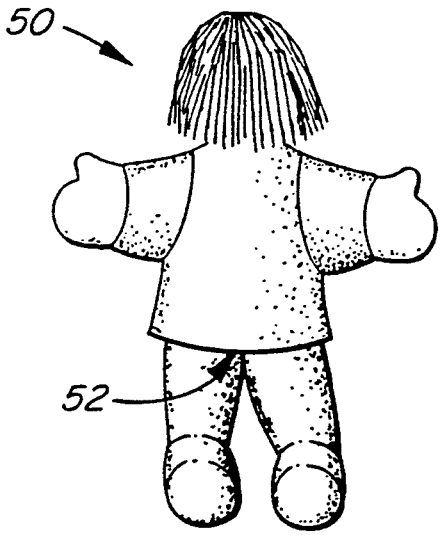

In FIG. 5, a doll 50 is shown which can be manipulated by inserting the hand under the shirt at the back of the doll, as shown at 52.

Figure 6:
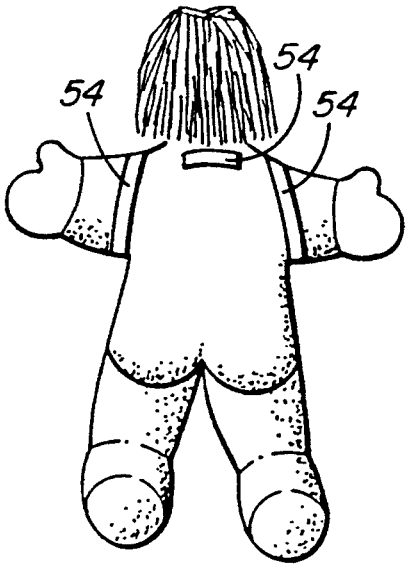

In the embodiment shown in FIG. 6, loops or strings 54 are provided on the doll or the clothing of the doll for receiving the fingers and thumb for manipulation of the arms and head. Such loops or strings 54 can be strategically placed in any required part of the clothes of the doll to enable the doll to be manipulated by the hand.

It is contemplated that the dolls 10, 12 according to the invention can be supplied either singly or in pairs to promote the friendship aspect thereof. The manipulation of the dolls enables them to be animated to enact scenes as in the mind of a child, e.g. happy, creative or troubled mind. The dolls can be used to create real situations. They can be used to characterize the professions or role playing.

Instead of being provided on the hands, the magnets can be provided on the clothes of the doll.

The magnets 14 are conveniently in the form of round discs, as shown in FIG. 1 or FIGS. 11 through 17. The magnets may be such that the north pole is located on one flat side of the disc and the south pole on the other flat side. Thus, depending whether similar or different poles are placed facing upwards in the hand, the hands can be made to repel or attract each other, as desired. This could be used so that the left hands of the dolls will repel each other, whereas left and right hands will attract each other or any other desired combination. Thus, the dolls can be used for educational or therapeutic purposes, for example, in helping develop manual dexterity, creativity, self-expression, story telling, etc. for use by children, parents, teachers and therapists. The dolls may be related to the characters in puzzles, games, storybooks, etc.

Figure 11:
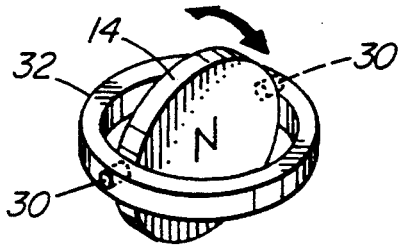
FIG. 11 is a perspective view of a swivelable type magnet for use in playthings according to the invention.
Figure 17:
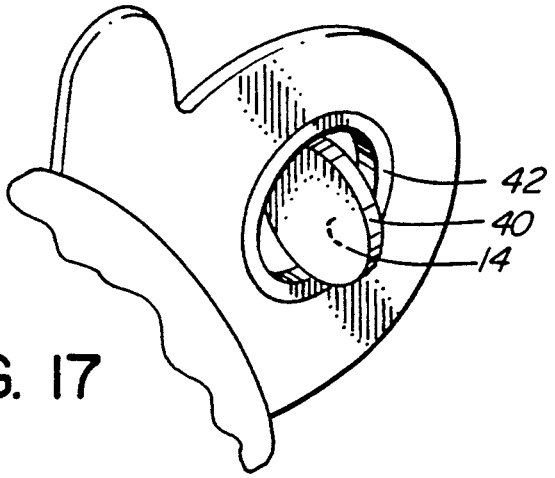
FIG. 17 is a perspective view showing a swivelable magnet provided on a hand of a plaything.

According to another embodiment of the invention, the magnet in at least one hand is swivelable about an axis, such as a diametrical axis, as shown in FIG. 17, to permit the magnet to orientate itself according to the force applied by an external magnetic field, such as produced by another magnet. Preferably, the magnets of both hands are swivelable about diametrical axes so that the magnets can orientate themselves according to each other's magnetic fields. An example of a swivelable magnet is shown in FIG. 11. A disc-shaped magnet 14 is shown with the north magnetic pole facing right (the south pole being on the side facing left). The magnet 14 can rotate about a diametric axis by means of diametrically opposed projections 30 which are pivotally supported on a support frame 32. With this arrangement the magnetic forces will automatically flip a pair of magnets into an attracting position when two hands are brought together, so that the hands will always attract, i.e. a pair of dolls will always hold hands.

Figure 13:
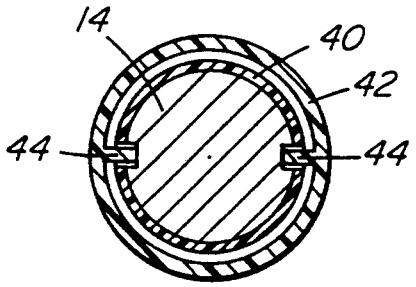
FIG. 13 is a plan view of a swivelable type magnet as shown in FIG. 11 but with the magnet itself being encased in a plastic casing.
Figure 14:
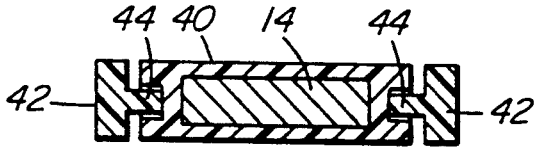
FIG. 14 is a diametrical section through the magnet of FIG. 13.

The magnet 14 may be open, as in FIG. 11, or encased snugly in a plastic casing 40, as shown in FIGS. 13 and 14. In this case the magnet 14 is supported by a plastic support frame 42 provided with a pair of diametrically opposed projections 44 for engagement with mating formations on the plastic casing 40 to provide a swivel axis.

Figure 12:
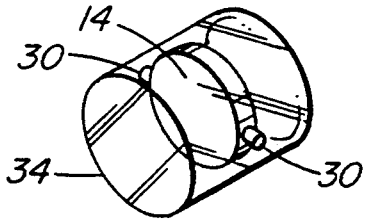
FIG. 12 is a perspective view of the magnet of FIG. 11 shown encased in a casing.
Figure 15:
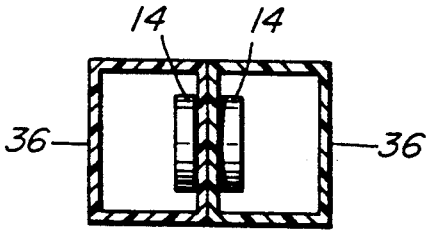
FIG. 15 is a sectional side view of a pair of encased magnets according to another embodiment of the invention.

Alternatively, the magnet 14 may be encased in an opaque or transparent plastic casing 34 with enough space inside to allow the magnet 14 to flip over, as shown in FIG. 12. The casing 34 is shown to be of cylindrical shape but it can be of any other desired shape, such as rectangular or cube-shaped. Alternatively, the magnet 14 can be loosely encased in a suitable casing 36 without being mounted on a swivel axis in which case the magnets 14 can orientate themselves inside the casings 36 into mutually attracting positions when the hands of the playthings are brought together, as shown in FIG. 15. In FIG. 15, the hands have been omitted and only the magnets 14 and the casings 36 are shown.

Figure 16:
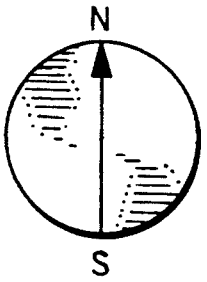
FIG. 16 is a plan view of a disc-shaped magnet with diametrically extending magnetic axis.

According to yet another embodiment, the magnets may be such that the magnetic poles are located diametrically opposite each other on the disc, as shown in FIG. 16. With this arrangement the magnets will attract each other depending on the relative orientation of their magnetic axes.

Figure 10:
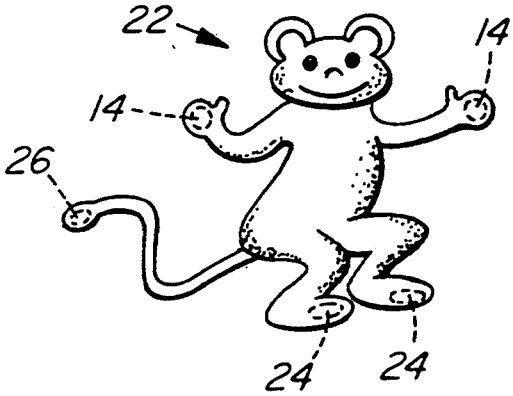
FIG. 10 is a schematical illustration of a magnetic plaything in the form of a plush animal according to another embodiment of the invention.

If desired, a magnet can be provided in the one hand of a plaything only or in other parts of the body, such as in the head or feet of the plaything. Furthermore, the playthings can take any form, such as stuffed toys, hard dolls, dolls of a flexible plastic or rubber material or plush animals. In the case of a plaything representing an animal, such as a monkey 22, shown in FIG. 10, the magnets 14 can be provided in the feet and tail as well as in the hands, as shown at 24 and 26 in FIG. 10. Thus the monkey 22 can use its tail and feet for holding onto a metal object, another monkey or a metal surface.

Figure 18:
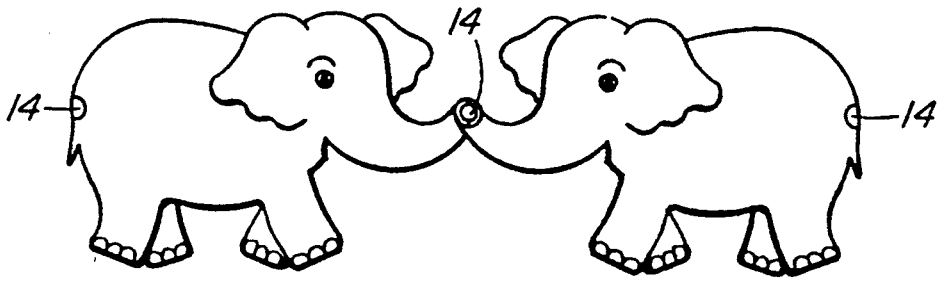
FIGS. 18 through 20 are side views of playthings in the form of elephants having trunks and tail ends provided with magnets.
Figure 19:
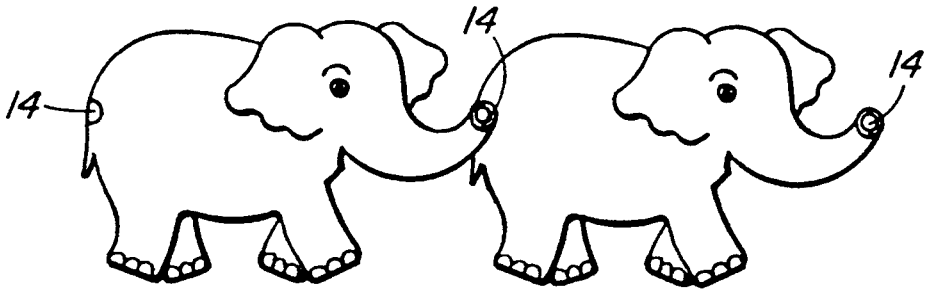
Figure 20:
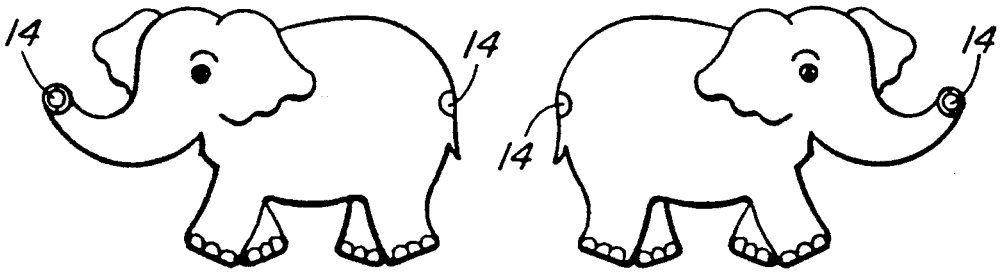

In the case of the playthings being in the form of elephants, as shown in FIGS. 18 through 20, the magnets 14 can be provided in the trunks and in the tails or on the tail ends of the elephants, as shown. Thus, in the present example, the magnets 14 in the trunks are arranged so that they will attract each other so that the elephants can "hold trunks", as shown in FIG. 18, but the magnets in the tail ends are arranged so that they will not attract, as shown in FIG. 20, where the tails are not attached to each other. However, the magnets 14 may be arranged so that the magnet 14 in the trunk of one elephant will attract the magnet 14 in the tail end of another elephant as shown in FIG. 19. The magnets 14 may either be fixed and embedded in the tail or trunk or they may be swivelable, as described above, e.g. the magnets 14 in the tails may be fixed and the magnets 14 in the trunks may be swivelable. Thus, in this configuration, the magnets 14 in the tails will always repel each other, whereas the magnets 14 in the trunks are swivelable to attract the magnet in another elephant, irrespective of whether it is in the trunk or the tail.

As an alternative to the magnets 14, rubber suction pads or strips of a hook and loop type material (VELCRO) may be used. The playthings may further be provided in combination with metallic or magnetic objects which can be "picked up" by the plaything.

While only preferred embodiments of the invention have been described herein in detail, the invention is not limited thereby and modifications can be made within the scope of the attached claims.

What is claimed is:

1. A plaything comprising a body, a pair of arms, each terminating in a hand, extending from said body and a magnet on each hand for removably attaching the hands together wherein the magnet on at least one hand is swivelable about an axis to permit said magnet to orientate itself according to the force applied by an external magnetic field.

2. The plaything according to claim 1, wherein the magnets of both hands are swivelable to permit the magnets to orientate themselves according to each other's magnetic fields.

3. The plaything according to claim 1, which is in the form of a stuffed fabric doll.

4. The plaything according to claim 1, which is in the form of a moulded plastic doll.

5. The plaything according to claim 1, which is in the form of a plush animal.

6. The plaything according to claim 5, wherein the animal has four of said arms, two of which represent legs.

7. The plaything according to claim 6, wherein the animal further has a tail provided with a magnet on the tail.

8. The plaything according to claim 7, wherein the animal is a monkey.

9. The plaything according to claim 1, which is in the form of a moulded plastic animal.

10. The plaything according to claim 1, which is in the form of a marionette.

11. The plaything according to claim 1, which is in the form of a glove puppet.

12. The plaything according to claim 1, which further comprises recesses in the arms and a head with a recess therein for insertion of the fingers and thumb into said recesses for manipulating the plaything.

13. The plaything according to claim 1, wherein the plaything is provided with clothing having loops thereon for receiving the fingers or thumb to enable the plaything to be manipulated by the hand.

14. A pair of playthings, each comprising a body and at least one arm terminating in a hand on the body of each plaything and a magnet on each of said hands for removably attaching said hands of the respective playthings together wherein the magnet on at least one hand is swivelable about an axis to permit said magnet to orientate itself according to the force applied by an external magnetic field.

15. The pair of playthings according to claim 14, wherein each plaything has a pair of arms, each terminating in a hand, and one of said magnets being provided on each hand of each plaything for removably attaching the hands of the same or different playthings together.

16. The pair of playthings according to claim 15, wherein said magnet is provided on the palm of each hand.

17. The pair of playthings according to claim 15, wherein each of said playthings further comprises recesses in the arms and a head with a recess therein for insertion of the fingers and thumb into said recesses for manipulating the plaything.

18. The pair of playthings according to claim 14, wherein each of said playthings is in the form of a stuffed fabric doll.

19. The pair of playthings according to claim 14, wherein each of said playthings is in the form of a moulded plastic doll.

20. The pair of playthings according to claim 14, wherein each of said playthings is in the form of a plush animal.

21. The pair of playthings according to claim 14, wherein each of said playthings is in the form of a marionette.

22. The pair of playthings according to claim 14, wherein each of said playthings is in the form of a glove puppet.

23. A pair of playthings, each representing an elephant and each comprising a body and two appendages extending from the body of each plaything and a magnet on each appendage for magnetic interaction with each other, wherein the magnet on at least one appendage is swivelable about an axis to permit said magnet to orientate itself according to the force applied by an external magnetic field and wherein said appendages on each plaything represent a tail and a trunk, respectively.

* * * * *